US006837560B2

(12) United States Patent
Ebisawa

(10) Patent No.: US 6,837,560 B2
(45) Date of Patent: Jan. 4, 2005

(54) INK-JET RECORDING APPARATUS, AND METHOD FOR OPERATING THE SAME

(75) Inventor: Isao Ebisawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/446,706

(22) Filed: May 29, 2003

(65) Prior Publication Data

US 2003/0227496 A1 Dec. 11, 2003

(30) Foreign Application Priority Data

Jun. 5, 2002 (JP) ..... 2002-164299

(51) Int. Cl.[7] ..... B41J 29/38; B41J 2/195
(52) U.S. Cl. ..... 347/7; 347/14
(58) Field of Search ..... 347/7, 19, 85

(56) References Cited

U.S. PATENT DOCUMENTS

| | | | | |
|---|---|---|---|---|
| 4,775,871 A | | 10/1988 | Abe et al. | 346/140 R |
| 5,289,207 A | | 2/1994 | Ebisawa | 346/140 R |
| 5,428,380 A | | 6/1995 | Ebisawa | 347/35 |
| 5,748,207 A | | 5/1998 | Inui et al. | 347/43 |
| 6,070,958 A | * | 6/2000 | Kanome | 347/7 |
| 6,155,664 A | * | 12/2000 | Cook | 347/7 |

FOREIGN PATENT DOCUMENTS

| | | |
|---|---|---|
| JP | 59-207259 | 11/1984 |
| JP | 7-32606 | 2/1995 |

* cited by examiner

*Primary Examiner*—Michael S. Brooke
(74) *Attorney, Agent, or Firm*—Fitzpatrick, Cella, Harper & Scinto

(57) ABSTRACT

A recording head has a subtank. The amount of ink remaining within the subtank is detected or calculated by a device, and the amount of ink necessary for an image of at least one recording sheet is calculated by another device. The two amounts of ink are compared. If it is determined that the ink remaining within the subtank is smaller, the recording head is moved to an ink replenishing mechanism provided outside of a printing range of a recording apparatus. The subtank mounted in the recording head is connected to the ink replenishing mechanism, and ink is supplied from the main tank. Ink replenishment is executed by a system for supplying ink using a pressurizing device or a negative-pressure device. By executing an operation of wiping ink adhering to a nozzle portion of the recording head and preliminary discharge not relating to printing after a recovery operation for the recording head, it is possible to realize stable ink discharge and obtain a high-quality image.

11 Claims, 12 Drawing Sheets

INK-JET RECORDING APPARATUS, AND METHOD FOR OPERATING THE SAME

BACKGROUND OF THE INVENTION

1. Field of the Invention

The present invention relates to an ink-jet recording apparatus for forming an image on a recording material by discharging ink, and a method for operating the same. For example, the invention relates to an ink-jet recording apparatus that has subtanks, each for holding a relatively small amount of ink to be supplied to an ink-jet recording head that has integrally formed nozzles (discharge ports) for discharging ink liquids of a plurality of colors, and in which ink is replenished from a main tank to a corresponding subtank while printing is not performed when the amount of ink remaining within the subtank becomes small, and a method for operating the ink-jet recording apparatus. The invention also relates to an ink-jet recording apparatus in which ink is supplied to a recording head moved to an ink replenishing mechanism provided outside of a printing range when it has been detected that the remaining amount of ink becomes small during a printing operation, and a method for operating the ink-jet recording apparatus.

Particularly, the present invention relates to improvement of a method for operating an apparatus for injecting ink by an ink replenishing mechanism when the amount of ink remaining within a subtank decreases, and allows maintenance of stable ink supply when executing ink replenishment and stability of printing after ink supply. It is preferable to provide a joint portion for preventing leakage of ink between the recording head and the ink supply mechanism, and to prevent entrance of a gas or dust from the outside.

2. Description of the Related Art

In an ink-jet recording apparatus, ink is supplied to a recording head, and an image is formed by providing a pattern made of ink dots on a recording material, such as paper or the like, by driving ink-droplet discharge means, such as piezoelectric elements, electrothermal transducers or the like, provided in the recording head based on image data. A recording head for obtaining a color image usually has discharge ports for discharging ink droplets of different colors, such as yellow, magenta, cyan and black. In a scanning-type recording apparatus, the above-described recording head is mounted on a carriage reciprocating in predetermined directions along a recording medium. Usually, one head has one type of ink, and, in most cases, a plurality of heads are arranged in a main scanning direction.

However, since it is disadvantageous to have a plurality of heads as described above, from the viewpoint of the cost and the size of the apparatus, heads have been devised in each of which discharge ports of ink liquids of a plurality of colors are integrated. A recovery operation for such a head may be executed using individual caps, recovery means or the like. However, since provision of individual components is disadvantageous from the viewpoint of the cost and the size, execution of a simultaneous recovery operation for nozzles for ink liquids of a plurality of colors with a common cap has been proposed. In this case, when a recovery operation becomes necessary, all of nozzles for ink liquids of a plurality of colors are simultaneously subjected to a recovery operation.

Reduction of the size of an ink tank integrally formed with a head unit will result in reduction of the number of printable sheets, and consumption of ink during a printing operation may occur. In order to solve such problems, an ink-remaining-amount sensor may be provided within the ink tank. Anyway, in order to manage the amount of ink, the amount of ink must be maintained by estimating the maximum amount of ink required for images to be printed.

It has been known, in a head in which discharge ports of ink liquids of a plurality of colors are integrated and an ink tank integrally configured with the head, to supply ink by exchange of an ink cartridge or a replenishing mechanism of ink after an ink liquid of a particular color has been completely consumed. In a recording head in which ink liquids of a plurality of colors are provided on the same plane, when ink is supplied from a main tank to a subtank integrally mounted with a head, ink liquids of respective colors discharged onto a recording sheet are mixed to produce color mixture.

Usually, a subtank has means for maintaining a negative pressure generated as ink used during a printing operation is being consumed in an equilibrium condition. For example, in a sponge-type ink tank, an equilibrium condition can be maintained by taking air from a hole communicating with the atmospheric air that is provided in a tank receptacle, in place of ink consumed from the ink tank.

A bag-shaped raw ink tank made of an aluminum sheet or the like contains ink. Such a raw ink tank has means for generating a predetermined negative pressure, so that as the amount of ink within the raw ink tank is reduced, a negative-pressure state within the raw ink tank can be maintained within a predetermined range, for example, by contraction of the bag.

When replenishing ink from a main tank to an ink tank (hereinafter termed a "subtank") connected to the head by an ink replenishing mechanism, for example, the main tank may be pressurized (for example, as disclosed in Japanese Patent Application Laid-Open (Kokai) No. 7-32606 (1995), or a suction operation may be executed via the head (for example, as disclosed in Japanese Patent Application Laid-Open (Kokai) No. 59-207259 (1984)).

SUMMARY OF THE INVENTION

The present invention relates to improvement of an apparatus for supplying ink from a main tank to a subtank when the amount of ink remaining within the subtank becomes small.

According to one aspect of the present invention, an ink-jet recording apparatus includes an ink tank having an ink accommodating portion for storing ink to be discharged from a discharge port, a carriage for moving while mounting the ink tank, a main tank separable from the ink tank having a supply portion to be connected to the ink accommodating portion of the ink tank when replenishing ink to the ink tank, derivation means for deriving an amount of ink remaining within the ink tank, calculation means for calculating an amount to be used of ink based on data to be recorded, comparison means for comparing the amount of ink remaining within the ink tank derived by the derivation means with the amount to be used of ink calculated by the calculation means, and control means for performing control so that when it is determined that ink is to be replenished to the ink tank as a result of comparison by the comparison means, the ink tank is moved by the carriage, the ink accommodating portion of the ink tank is connected to the supply portion of the main tank, and ink is replenished from the main tank to the ink tank.

According to another aspect of the present invention, a method for operating an ink-jet recording apparatus including an ink tank having an ink accommodating portion for storing ink to be discharged from a discharge port, a carriage for moving while mounting the ink tank, and a main tank separable from the ink tank having a supply portion to be connected to the ink accommodating portion of the ink tank when replenishing ink to the ink tank, includes a derivation step of deriving an amount of ink remaining within the ink tank, a calculation step of calculating an amount to be used of ink based on data to be recorded, a comparison step of comparing the amount of ink remaining within the ink tank derived in the derivation step with the amount to be used of ink calculated in the calculation step, and a moving step of moving the ink tank by the carriage when it is determined that ink is to be replenished to the ink tank as a result of comparison in the comparison step, a connection step of connecting the accommodating portion of the ink tank to the supply portion of the main tank, and a replenishing step of replenishing ink from the main tank to the ink tank.

In the present invention, when ink in one of subtanks of a plurality of colors is completely consumed, or when means for detecting that the amount of ink remaining in one of the subtanks becomes small operates, it is determined whether or not the amount of ink is insufficient compared with the amount of ink within the one of the subtanks, by calculating the amount of ink of the corresponding color from data to be printed.

If means for calculating the remaining amount of ink at any time is provided for an ink tank of each color substantially integrally configured with a head, by calculating how much amount of ink is to be consumed for an image to be subsequently printed, it is possible to perform continuous printing, allow ink replenishment whenever necessary, improve the throughput of printing, and prevent complete consumption of ink during printing.

When it is determined that the amount of ink remaining in one of the subtanks is small, the recording head moves to an ink replenishing mechanism provided outside of a printing range of the recording apparatus, the ink replenishing mechanism is connected to the one of the subtanks mounted in the head, and ink is supplied from a corresponding one of the main tanks.

In order to replenish ink, the ink replenishing mechanism has a system to supply ink by a pressure difference, such as means for pressurizing the inside of the main tank, means for generating a negative pressure within the subtank, or the like.

When replenishing ink by pressurizing means, a recovery operation can also be executed by discharging a very small amount or a predetermined amount of ink from a nozzle portion of the head. When replenishing ink by the negative-pressure means, a recovery operation can also be executed by sucking a very small amount or a predetermined amount of ink from the nozzle portion of the head.

Ink discharged from the nozzles adheres to the surface of the head. In order to remove adhering ink droplets, by performing an operation of wiping the surface of the head and executing preliminary discharge that is not related to printing, color mixture of ink liquids of different colors is prevented. By removing a forced viscous substance using a wiper blade, it is possible to realize stable discharge and obtain a high-quality image.

The foregoing and other objects, advantages and features of the present invention will become more apparent from the following description of the preferred embodiments taken in conjunction with the accompanying drawings.

DESCRIPTION OF THE PREFERRED EMBODIMENTS (First Embodiment)

Figure 1:
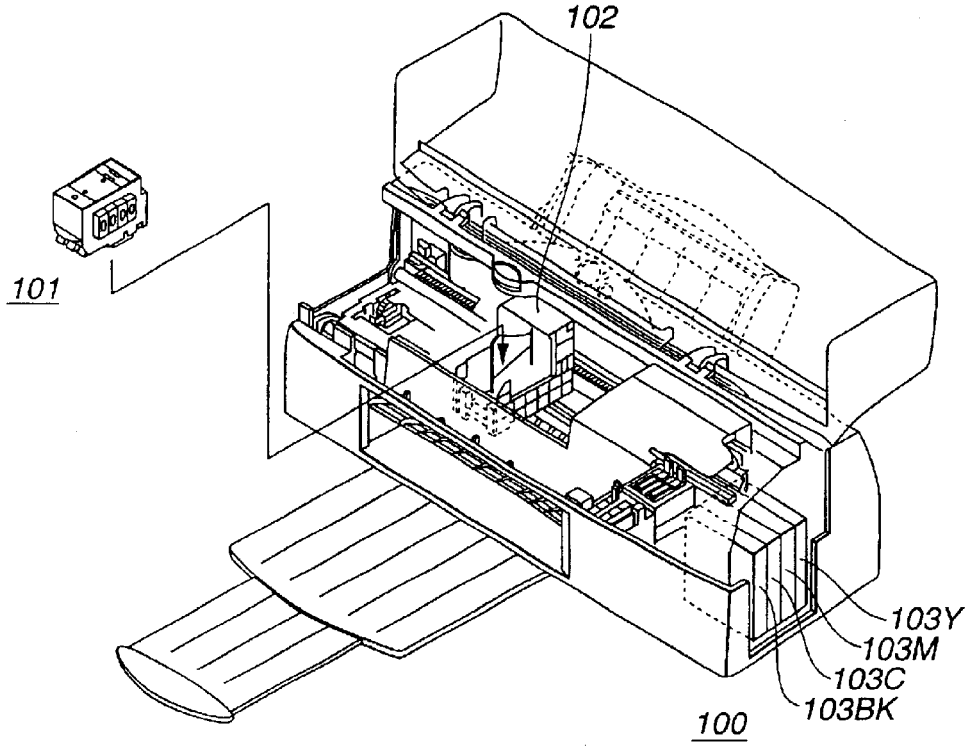
FIG. 1 is a perspective view illustrating the entirety of a color ink-jet recording apparatus according to a first embodiment of the present invention.

FIG. 1 is a perspective view illustrating the entirety of a color ink-jet recording apparatus according to a first embodiment of the present invention. In FIG. 1, there are shown a recording apparatus 100, and a color ink-jet head 101. The color ink-jet head 101 has a plurality of nozzles for four colors that are integrally formed, and corresponding subtanks that are substantially integrally formed. There is also shown a carriage 102.

Main tanks 103BK-103Y are provided in a state of being fixed outside of a printing range of the recording apparatus 100. Ink colors are adjusted with ink colors of the subtanks, and each of the subtanks is exchangeable. It is preferable that each of the main tanks has the function of detecting a remaining amount of ink, for example, using electrodes, or a highly transparent material so that the presence of ink within the main tank can be visually confirmed. The present invention is not limited to such a configuration. Any other appropriate detection function may also be provided.

Figure 2:
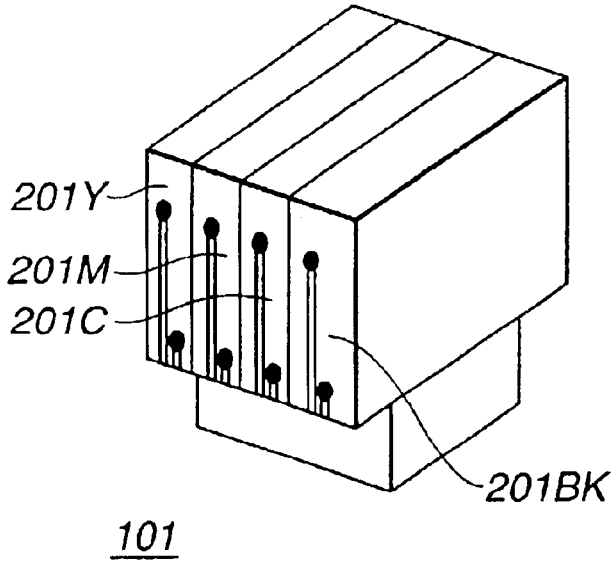
FIG. 2 is a perspective view illustrating a head in which subtanks are set, as seen from the side of the subtanks.

FIG. 2 is a perspective view illustrating a state in which a subtank 201BK for black, and subtanks 201C, 201M and 201Y for respective colors are integrally connected to the color ink-jet head 101. The color ink-jet head 101 and the subtanks 201Bk, 201C, 201M and 201Y may substantially integrally configured so as to be exchangeable.

Figure 3:
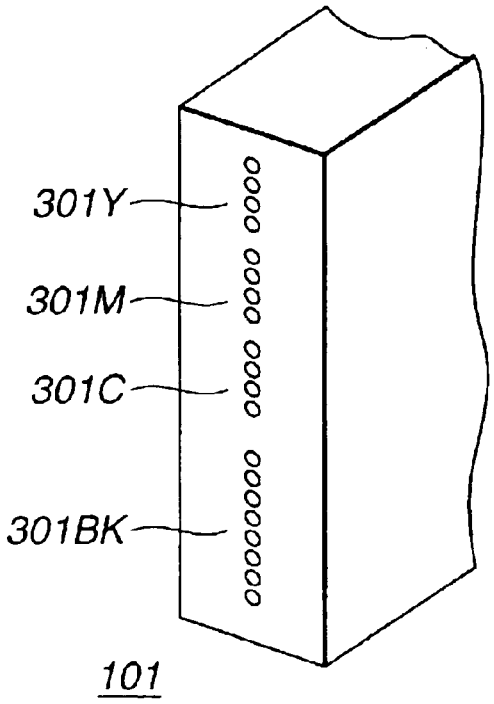
FIG. 3 is a perspective view illustrating the plane of discharge ports of the head.

As shown in FIG. 3, the color ink-jet head 101 has nozzles for four colors. A plurality of nozzles 301BK, 301C, 301M and 301Y are for discharging black ink, cyan ink, magenta ink and yellow ink, respectively. Although in FIG. 2, the subtanks 201BK, 201C, 201M and 201Y have the same size, the capacity may differ between the subtank 201BK for black and the subtanks 201C, 201M and 201Y for respective colors, because of the following reason. That is, since black ink is frequently used for texts and the like, a replenishing operation from the main tank 103BK can be minimized by using a large-size subtank. Each of the subtanks 201BK, 201C, 201M and 201Y may be exchangeable.

As for the size of the subtank, it is necessary to consider the size of the entire head unit. It is desirable to optimize the size of the subtank, because a careless increase of the size of the subtank may result in an increase of the space of the main body of the apparatus and an increase of the motor load during head driving when mounting the carriage.

In an apparatus for mainly recording color images, it is possible to increase the capacity of a subtank for a particular color in consideration of images required by the user. For example, for a user who prints a large amount of color graphic images, it is possible to increase the capacity of a particular subtank. For example, for a user who intents to provide "blue slides" having a blue background in an OHP (overhead projector) or the like, the capacity of subtanks for cyan and magenta may be increased.

Although in the first embodiment, ink tanks for four colors, i.e., black, cyan (C), magenta (M) and yellow (Y), are integrally formed so as to be connected to supply ports of the head, the present invention is not limited to such a configuration. For example, a recording apparatus having an ink system using variable-density ink liquids of six or seven colors may also be adopted.

Figure 4:
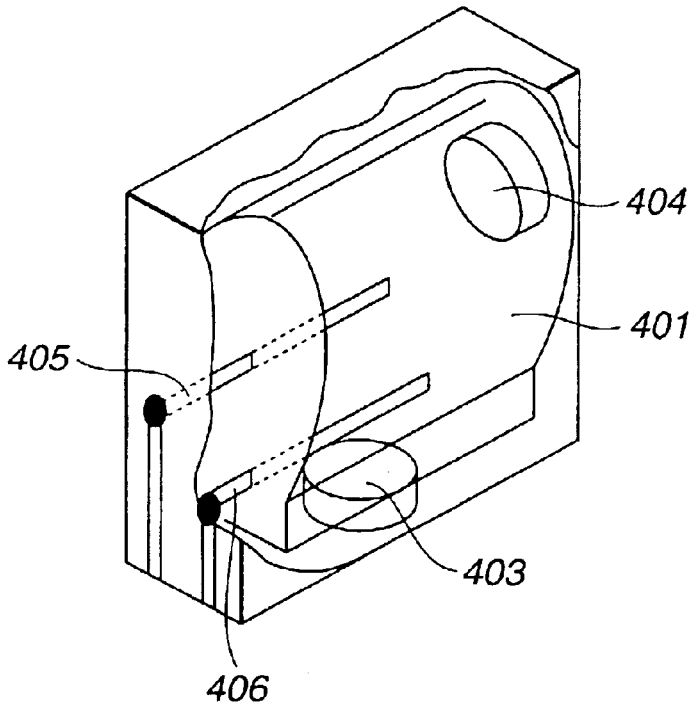
FIG. 4 is a broken perspective view of one of the subtanks shown in FIG. 2.

FIG. 4 is a perspective view illustrating the configuration of one of the subtanks shown in FIG. 2. The subtank mounted in the head desirably has an appropriate size. If the size is too small, ink must be frequently supplied during a printing operation. If the size is too large, the subtanks occupy a large space in the recording apparatus, resulting in an increase of the weight of the carriage and an increase of the load.

If the amount of ink is sufficient enough for printing an image with a duty ratio of 100% for each color at least for a maximum-size sheet that can be passed, an apparatus in which complete consumption of ink during a printing operation does not occur can be designed. Accordingly, it is desirable to determine the capacity of the subtank by taking into consideration of the characteristics of the apparatus. In the first embodiment, the amount of ink that allows two printing operations with a duty ratio of 100% for a maximum-size sheet that can be passed is set. For example, in an ordinary text document, the duty ratio of printing is about 5–7%, so that printing of about 28–40 sheets can be performed with one ink replenishment. With photographic picture quality, the average duty ratio of indoor and outdoor scenes is about 50–60%, and it is designed to realize printing of about 3–4 sheets.

In the present invention, a preferable range is to accommodate an amount of ink equal to or more than and equal to or less than twice the amount of ink necessary for performing recording with a duty ratio of 100% on the surface of a maximum-size recording medium that can be recorded by the ink-jet recording apparatus in the subtank.

A subtank 401 shown in FIG. 4 may utilize a sponge absorber, a raw ink bag or the like provided that a predetermined negative-pressure function is provided, and there is no limitation in the configuration of the subtank 401. In the first embodiment, a subtank utilizing a raw ink bag will be described. The raw ink tank is made of a material through which gases and moisture do not permeate, such as an aluminum laminated film or the like. A port for supplying the head with ink and an injection port for receiving replenishing of ink from the main tank are provided at both ends of the raw ink tank.

Each of the subtanks 201Bk-201Y holds ink by a bag made of an aluminum sheet or the like. Two electrodes are provided at a side opposite to the ink replenishing port, in order to detect ink when the amount of ink becomes small. Since ink itself is usually conductive, the presence of ink can be electrically detected.

A port 403 is for supplying the recording head with ink, and electrodes 405 and 406, serving as a sensor for detecting the remaining amount of ink, are arranged above and below the port 403. As the amount of ink within the subtank decreases, the resistance value between the electrodes 405 and 406 increases, so that an ink-low state or absence of ink can be detected. In order to design the subtank so that the amount of ink is constant when detecting the ink-low state, it is important to devise the positions of the two electrodes and the shape of the subtank.

The electrodes 405 and 406 within the subtank are connected to a head substrate for providing the head with a printing signal, a driving source and the like. The head substrate, is connected to an electric substrate within the main body of the apparatus by being connected to electric connection means provided in a head holder, a carriage or the like of the main body of the apparatus.

In accordance with execution of printing, the amount of ink within the subtank of the head decreases. Since the capacity of the subtank is designed to be relatively small as described above, there is the possibility that complete consumption of ink occurs in the midst of continuous printing of a large number of dots. In order to prevent such a problem, in this recording apparatus, by measuring in advance the estimated duty ratio for each color of R, G and B or C, M, Y and K of image data to be printed and the estimated number of dots to be printed before starting printing, it is possible to manage the amount of ink during printing and prevent complete consumption of ink.

More specifically, when outputting a printing start command from a PC (personal computer) from a driver, the number of dots of each of C, M, Y and K when developing an image for one recording sheet to be printed is counted, and it is determined whether or not the amount of ink within the subtank is sufficient by performing comparison. If the result of the determination is affirmative, printing is started. If the result of the determination is negative, printing is started after replenishing ink from the main tank provided in the recording apparatus before starting printing.

The amount of ink consumed during an image printing operation can be calculated by counting the number of ink discharges from nozzles for each color, and multiplying the counted number by the amount of discharge per droplet. The number of ink discharges can be counted within the recording apparatus at any time, for example, during a printing operation or after completing the printing operation, so that the amount of ink remaining within the subtank can be calculated.

Accordingly, when the number of dots of an image to be printed is represented by N, the amount of ink discharge is represented by Vs, and the amount of ink consumed in a recovery operation is represented by Vp, the amount of ink necessary for printing is expressed as $Vg=Vs\times N+Vp$. When the amount of ink remaining within the subtank is represented by Vr, a printing operation can be continued if $Vg<Vr$, and ink replenishment from the main tank is executed if $Vg>Vr$.

When it has been detected that the amount of ink remaining in the ink bag 401 within the subtank is small, the head moves in order to be subjected to ink supply from the main tank provided outside of a printing range of the recording apparatus (not shown). In this state, an ink supply port (receiving portion) 404 shown in FIG. 4 can be connected to the supply portion of the main tank.

The management of ink in the subtank is performed by calculating the remaining amount of ink for each color. As for ink replenishment, start of printing or ink replenishment may be executed by determining whether or not the amount of ink is sufficient for an image to be printed by comparing the remaining amount of ink with the amount of ink to be used, or by managing the amount of ink of a color that is smallest within the subtank.

In the first embodiment, the minimum amount of ink within the subtank is managed. It is arranged such that when the amount of ink remaining within the subtank becomes less than 20%, an ink replenishing operation is performed unconditionally. This is because the amount of ink is calculated from the amount of ink discharge by counting dots, and errors due to variations in the amount of ink discharge and in a recovery operation are taken into consideration.

If a printing operation is terminated in a state in which the amount of ink remaining within the subtank is very small, and the head is left in this state, ink may clog nozzles due to evaporation of water. By leaving the head in a state in which a certain amount of ink remains, it is possible to easily perform a recovery operation and improve stability of ink discharge. Although in the first embodiment, the minimum remaining amount of ink is set to 20%, the present invention is not limited to this value, provided that the value is within a range of 10–25%.

Figure 5:
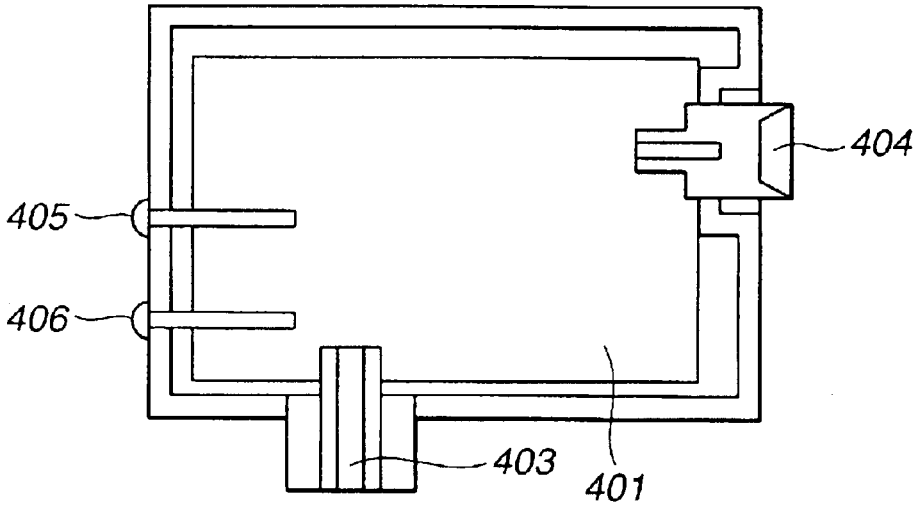
FIG. 5 is a cross-sectional view illustrating the subtank shown in FIG. 4.

FIG. 5 is a lateral cross-sectional view of the subtank. In FIG. 5, reference numerals represent corresponding portions in FIG. 4. Ink is supplied from the ink supply port 403 provided at the base of the subtank. The electrodes 405 and 406 for detecting the remaining amount of ink are provided. When the remaining amount of ink is detected to be small by the electrodes 405 and 406, ink can be replenished from the connection port (receiving port) 404 with the main tank.

When information relating to detection by the electrodes 405 and 406 arrives, the head is moved to the position of the ink replenishing means provided outside of the printing region. Ink can be replenished by connecting the subtank to connection means of the ink replenishing mechanism.

Figure 6:
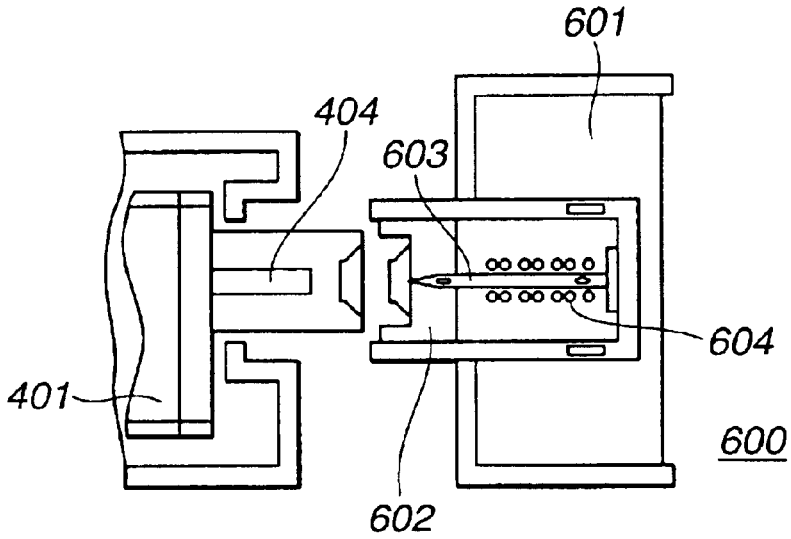
FIG. 6 is a cross-sectional view illustrating a state before a subtank is connected to a main tank, in the first embodiment.
Figure 7:
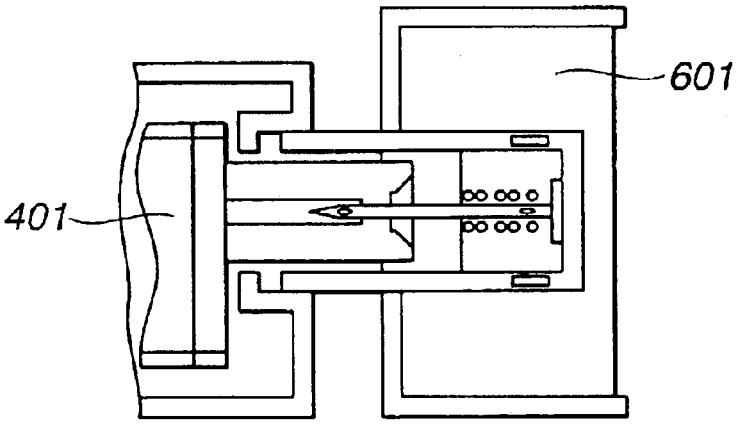
FIG. 7 is a cross-sectional view illustrating a state in which the subtank is connected to the main tank, in the first embodiment.

FIG. 6 is a cross-sectional view illustrating a state before the subtank is connected to the ink replenishing mechanism after ink within the subtank is used out. FIG. 7 is a cross-sectional view illustrating a state in which the subtank is connected to the ink replenishing mechanism and ink is replenished. The ink replenishing mechanism has pressurizing means or means for performing negative-pressure suction for the subtank (not shown), and supplies ink into the subtank. The pressurizing means is not limited to specific means, provided that a very small pressure can be generated. Pressurization may be performed from above or from a lateral direction.

In FIG. 6, reference numeral 600 represents a main tank. The main tank 600 is fixed within the recording apparatus in an exchangeable state, and has a guide unit, such as a projection or the like, so as to be excellently fitted to the subtank. The main tank 600 contains ink 601 and also has an injection mechanism for replenishing ink while communicating with the subtank. The injection mechanism is not limited to a specific mechanism.

The guide unit has an elastic member 602 having a sealing property and a needle 603 for injecting ink. When the subtank is inserted, the sealing elastic member 602 is pushed into the subtank to protrude the injection needle 603. A threaded hole is formed in the needle 603. The ink 601 within the main tank 600 can be supplied to the bag 401 within the subtank via the threaded hole.

When replenishment of ink has been completed, the subtank is detached from the main tank 600. A spring member 604 for returning the sealing elastic member 602 present within the main tank to the original position when detaching the subtank is provided.

Figure 8:
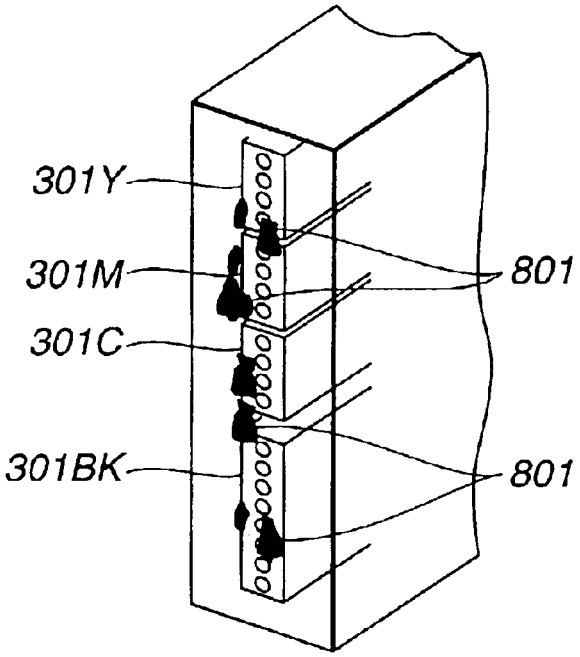
FIG. 8 is a perspective view illustrating an example of the surface of the head when an operation of pressurized replenishment of ink is executed in the first embodiment.

FIG. 8 illustrates an example of the state of the surface of the recording head when ink is supplied from the main tank by being pressurized. When ink is supplied by being pressurized, ink 801 discharged from nozzles sometimes adheres. At that time, since nozzles for a plurality of colors are rectilinearly arranged in the recording head, ink liquids are mixed, and ink of a certain color sometimes penetrates into the recording head from the corresponding nozzle. FIG. 8 illustrates such a state.

In order to remove ink of another color penetrating into a nozzle, ink discharge not relating to a printing operation may be performed. However, it is necessary to consume a relatively large amount of ink for removing color mixture when ink has penetrated into a rear portion of the head.

In the first embodiment, it is desirable to remove ink appearing when pressurizing ink, with a wiper blade in a short time. More specifically, it is desirable to remove ink within about five seconds immediately after processing when ink has been discharged from nozzles by being pressurized. An excellent result has been obtained by using a wiper blade made of urethane or HNBR having a shape relatively close to a plate. The shape of the wiper blade is not limited to a specific shape. Any wiper blade that can remove ink from the surface of the recording head has a sufficient effect for the present invention.

Removal of ink using the wiper blade is effective because color mixture caused by penetration of discharged ink into another nozzle is mitigated. We have confirmed that if removal of ink is executed after leaving the head for about 10 seconds, color mixture within a nozzle is diffused, and preliminary discharge for improvement must be intensively performed.

Figure 9A:
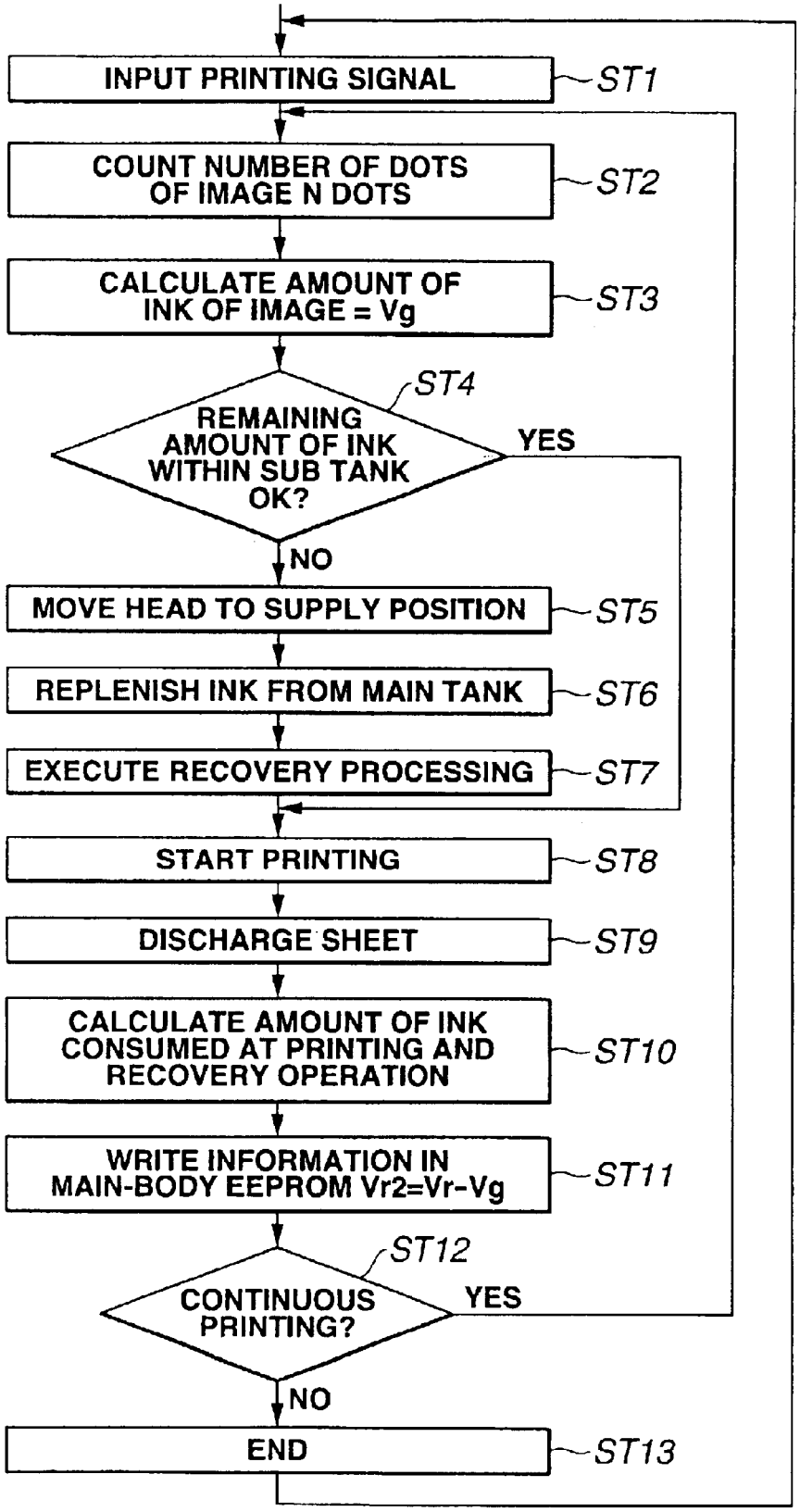
FIGS. 9A and 9B are flowcharts, each illustrating a sequence in the first embodiment.

FIG. 9A is a flowchart illustrating a sequence for performing processing according to the first embodiment. The process at each step will now be described (steps ST1–ST13).

ST1: A printing signal is input.

ST2: The number of dots of an image to be printed is counted for each color.

ST3: The amount of ink consumption is calculated from the counted number.

ST4: Comparison is performed in order to determine whether or not the amount of ink remaining within the subtank is sufficient. If the result of the determination in ST4 is affirmative, the process proceeds to ST8. If the result of the determination in ST4 is negative, the process proceeds to ST5.

ST5: The recording head (the subtank) is moved in order to be connected to the main tank.

ST6: Ink replenishment is executed.

ST7: A recovery operation is executed.

ST8: A printing operation is started.

ST9: The printing operation is completed, and a sheet discharging operation is performed.

ST10: The amount of ink consumed in the printing operation and the recovery operation is calculated.

ST11: The obtained information is written in a nonvolatile memory within the main body of the apparatus.

ST12: It is determined whether or not a continuous printing signal is present. If the result of the determination in ST12 is affirmative, the process returns to ST2. If the result of the determination in ST12 is negative, the process proceeds to ST13.

In recovery processing after executing a replenishing operation, ink droplets adhering to the surface of the head are wiped. After the wiping operation, a preliminary discharge operation not relating to a printing operation is executed. The number of preliminary discharges may be set so as to remove color mixture of respective colors.

Figure 9B:
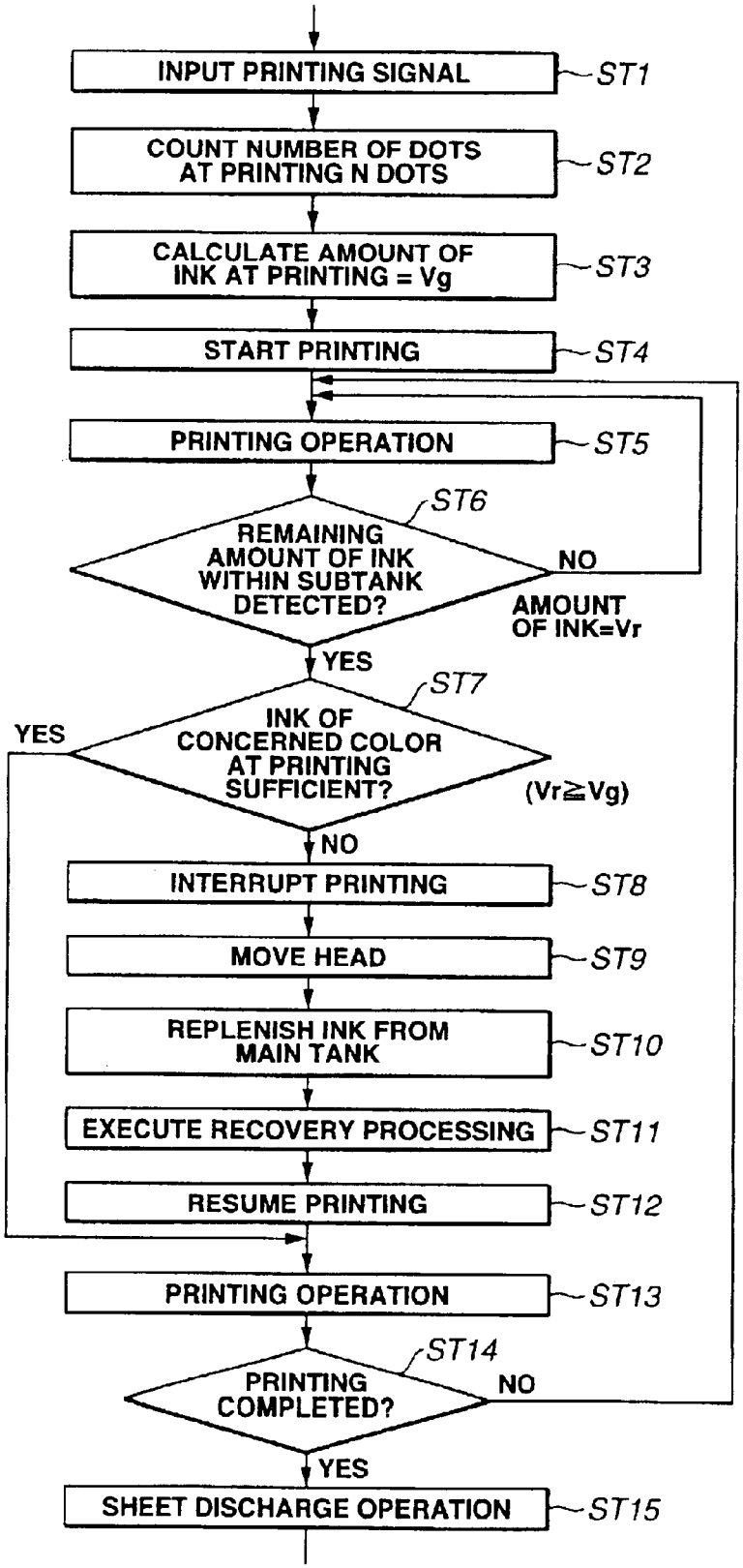

The flowchart shown in FIG. 9B illustrates the sequence of each step in which, when it is detected that the remaining amount of ink becomes small during a printing operation, the remaining amount is compared with the amount of ink necessary for an image to be subsequently printed. If there is no problem, the printing operation is continued. If it is determined that the amount of ink is insufficient, the printing operation is temporarily interrupted. After replenishing ink, the printing operation is resumed.

By starting a printing operation after calculating the amount of ink to be consumed for an image to be printed before the printing operation, it is possible to prevent complete consumption of ink during the printing operation, and effectively use ink within the subtank. In the means for detecting the amount of ink using electrodes provided within the subtank, by performing control by comparing the remaining amount of ink with the amount of ink to be consumed for an image to be printed when the remaining amount of ink within the subtank becomes small, it is possible to perform a stable printing operation with an improved total throughput.

(Second Embodiment)

Figure 10:
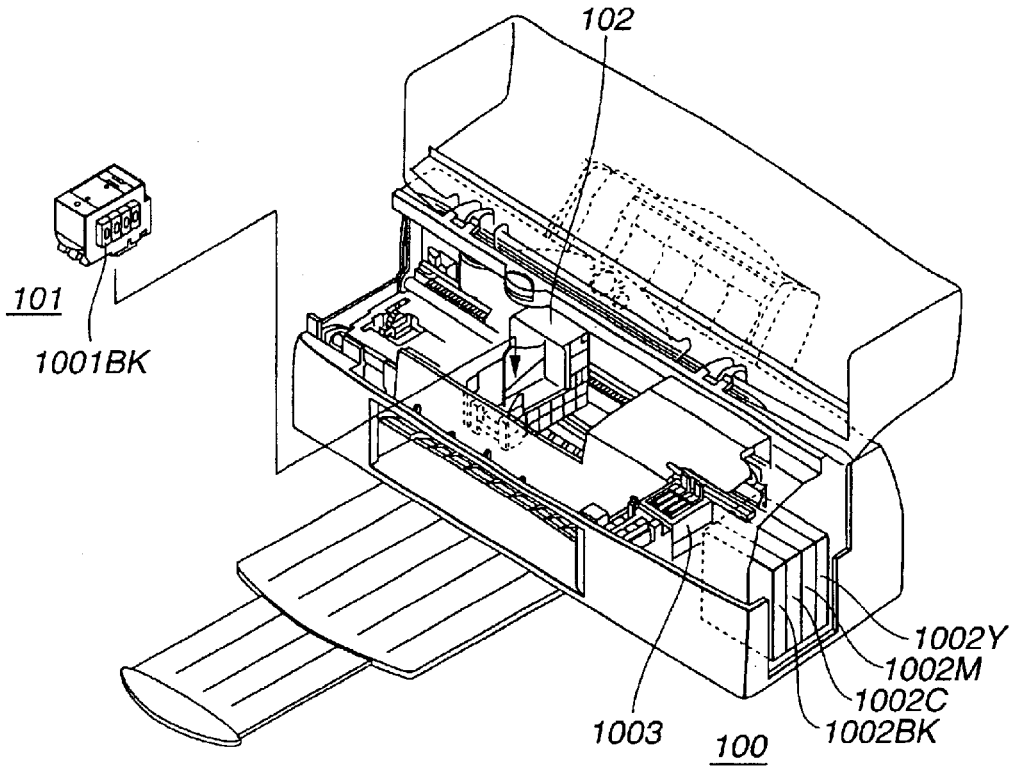
FIG. 10 is a perspective view illustrating an ink-jet recording apparatus according to a second embodiment of the present invention.

FIG. 10 is a perspective view illustrating an ink-jet recording apparatus according to a second embodiment of the present invention. In the ink-jet recording apparatus shown in FIG. 10, when executing ink replenishment, a recording head is moved to the position of a cap, and ink replenishment from a main tank is executed via a cap according to a suction recovery operation by suction. Pressurizing means is not provided in the main tank, but negative-pressure generation means is provided in the cap.

As shown in FIG. 10, in order to execute ink replenishment for a subtank 1001 of the recording head, the subtank 1001 can be simultaneously connected to both of a connection portion (not shown) of a main tank 1002 provided outside of a printing range of the recording apparatus and cap means 1003.

An ink suction operation may be executed for the entire head at a time, or for an individual head, by individually providing a cap member. That is, when remaining-amount detection means operates because ink of a specific color in the subtank is used out, only the concerned ink may be replenished.

Figure 11:
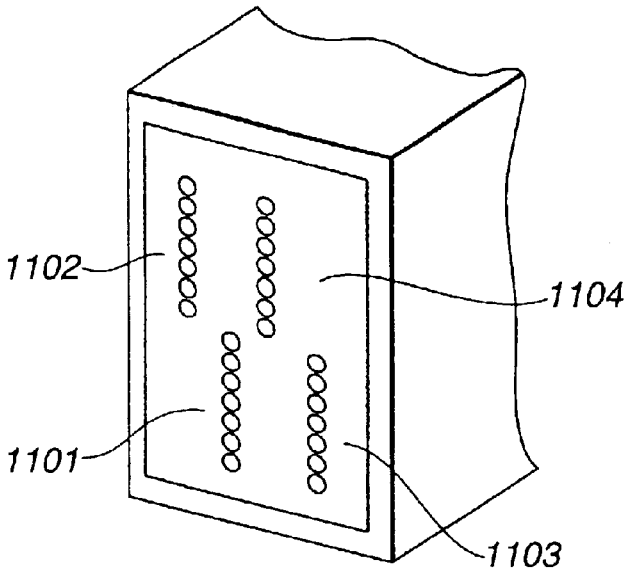
FIG. 11 is a perspective view illustrating the shape of another head according to the present invention.

FIG. 11 illustrates another head according to the present invention. Instead of rectilinearly arranging nozzles of a head, respective groups 1101, 1102, 1103 and 1104 of a plurality of nozzles are arranged on the same plane. The above-described effects may also be provided in such a head.

(Third Embodiment)

Figure 12A:
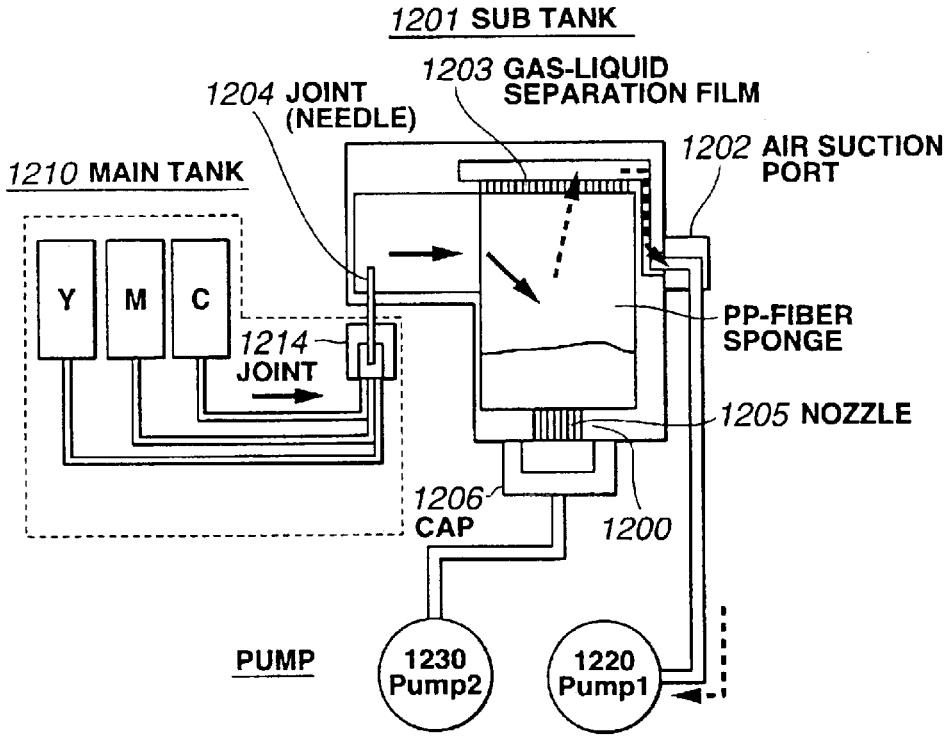
FIG. 12A is a schematic diagram illustrating an ink supply system according to a third embodiment of the present invention.
Figure 12B:
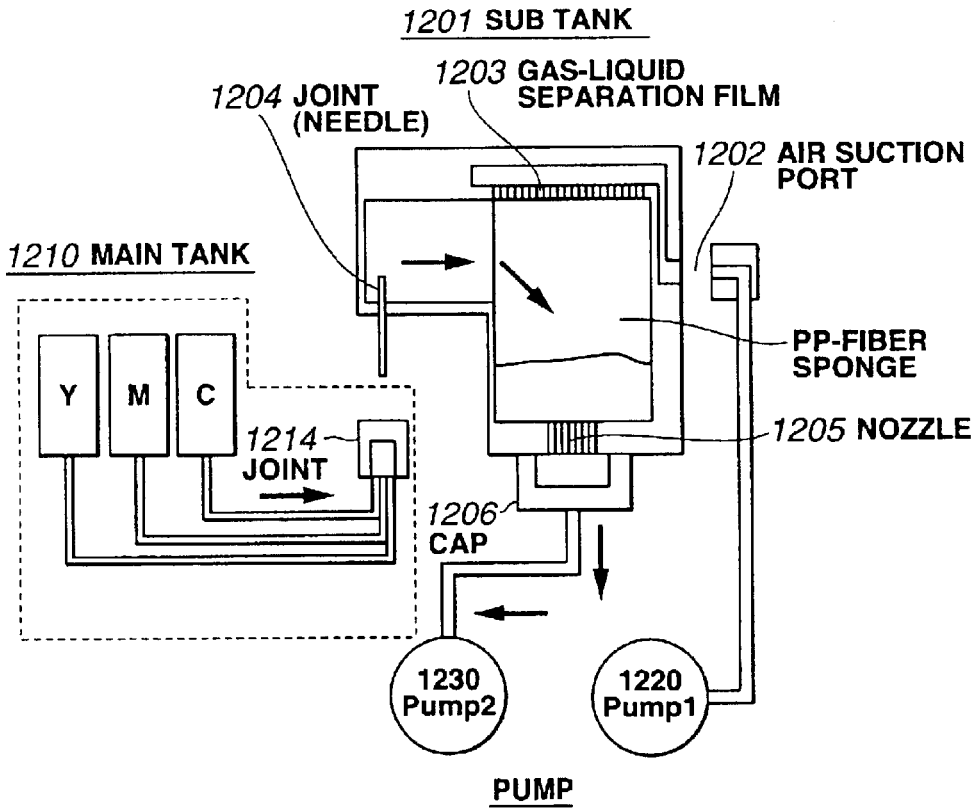
FIG. 12B is a schematic diagram when a recovery operation is executed in the third embodiment.

A third embodiment of the present invention will now be described. FIGS. 12A and 12B illustrate means for generating a negative pressure within a subtank mounted in a head, and supplying ink from a main tank using the negative pressure. In a recording head 1200, in order to discharge ink, a group of nozzles, a subtank 1201 and a carriage unit (not shown) capable of being connected to a main-body shaft are integrated.

A sponge (made of urethane or a PP(polypropylene)-fiber material) is provided as an ink absorbing member within the subtank 1201. As in the first embodiment, when using the sponge, accuracy in the resistance between electrodes is low. Since a try to improve the accuracy will result in an increase in the cost, the amount of ink consumption is obtained by counting the number of ink discharges.

A case of performing control using a well-known dot counting method as a method for detecting the remaining amount of ink will now be described. The amount of ink consumed for a printed image can be calculated by counting the number of ink discharges from nozzles for ink of each color, and multiplying the counted number by the amount of discharge per droplet. The number of ink discharges can be counted within the recording apparatus at any time, for example, during a printing operation or when the printing operation is completed, so that the amount of ink remaining within the subtank can be calculated.

Then, it is determined whether or not the amount of ink used for an image of one sheet to be printed is larger than the amount of ink remaining within the subtank 1201 by performing comparison. By thus performing control whether the printing operation is to be continued or ink is to be replenished from the main tank 1210, complete consumption of ink during the printing operation is prevented.

That is, when developing an image file for an image of one sheet to be printed for color processing by a PC driver, the number of dots for each of ink colors, i.e., C, M, Y and K, may be counted, and the amount of ink necessary for printing may be derived from the count value. When directly printing an image from a recording medium, such as a compact flash memory or a smart medium, as direct printing without passing through a PC, it is also possible to obtain the necessary amount of ink by counting the number of necessary dots for ink of each of C, M, Y and K when developing image data within the recording apparatus.

As a specific example, the subtank is designed to have a very small size, and the amount of ink is for one maximum-size sheet that can be passed through the main body of the apparatus. Accordingly, ink replenishment is executed at printing of one sheet with an image having a duty ratio of 100%. At least three sheets can be continuously printed with an image having a duty ratio of 20%.

A description will now be provided of a particular color in a subtank. When the total amount of ink (net) within the subtank is represented by $V_0$, the number of discharged ink droplets used for an image on a first sheet is represented by N1, the amount of ink discharge per droplet is represented by Vs, and the amount of ink used in a recovery operation is represented by Vp1, the remaining amount of ink Vr is expressed as follows:

$$Vr=V_0-Vs\times N1-Vp1.$$

This value may be compared with the amount of ink Vg used in an image to be printed on a second sheet. It is determined whether printing is to be continued or ink is to be replenished from the main tank, based on the result of comparison. Comparison of amounts of ink is executed for each ink color within the corresponding subtank.

When the number of dots necessary for one sheet of a second image to be printed is represented by N2, the amount of ink discharge is represented by Vs, and the amount of ink consumed in a recovery operation is represented by Vp2, the amount of ink Vg necessary for printing is expressed as $Vg=Vs\times N2+Vp2$. A printing operation can be continued if $Vg<Vr$, and ink replenishment from the main tank is executed if $Vg>Vr$.

A detailed description relating to the above-described processing will now be provided with reference to FIGS. 12A and 12B. Processing of replenishing ink from the main tank 1210 when it is determined that the amount of ink within the subtank 1201 is smaller than the amount of ink necessary for printing the subsequent image will be described in steps.

First, ink supply will be described with reference to FIG. 12A.

ST1: When the amount of ink within the subtank 1201 is less than the amount of ink necessary for an image to be subsequently printed, the recording head is moved to a position for supplying the subtank 1201 with ink. No problem will arise even if the position is also used as a capping position.

ST2: The subtank 1201 is connected to the main tank 1210. Connection means moves the recording head to the ink supply position, and then performs connection by inserting a joint (needle) 1204 provided in the subtank 1201 into a joint portion 1214 (made of a rubber material) of the main tank, or using separate driving means.

ST3: In the subtank 1201, an air suction opening 1202 for removing a gas (air) from the subtank 1201 is connected to a suction tube, and the suction tube is connected to a negative-pressure pump 1220 that can perform a suction operation. An gas-liquid separation film 1203 through which a gas can be permeated but a liquid cannot be permeated is provided at an upper portion of the subtank 1201. By sucking a gas (air) by a negative-pressure pump via the gas-liquid separation film 1203, the negative pressure within the subtank 1201 increases, and ink is supplied from the main tank to the subtank 1201 by the force of the increased negative pressure.

ST4: After the subtank 1201 is filled with ink, since the gas (air) is not present within the subtank 1201, ink supply is automatically stopped.

Next, a recovery operation after ink supply will be described with reference to FIG. 12B.

After ink is filled within the subtank 1201, an operation of sucking a predetermined amount of ink from a nozzle portion 1205 of the head is executed using a cap member 1206, in order prevent possible oozing of ink from the nozzle portion of the head because a slightly pressurized state is provided when the inside of the subtank 1201 is filled with ink.

ST5: The air suction opening 1202 and the joint 1204 at the connection portion between the subtank 1201 and the main tank are opened to the atmospheric air.

ST6: A suction operation is executed from the nozzle portion 1205 of the recording head via the cap member 1206 by the negative-pressure pump 1230. The negative-pressure pump 1230 is not limited to a specific pump. For example, it may use a piston and a cylinder, or may be a tube pump.

ST7: After the suction operation, since ink droplets adhere to the surface of the head, cleaning is executed using an elastic wiper blade made of rubber (not shown) or the like, and in order to remove mixed ink liquids pushed into nozzles, preliminary discharge not relating to printing is executed about a few thousand times.

ST8: An operation of printing the next image is started.

ST9: After completing the printing operation, the consumed amount of ink of each color discharged in the printing operation is calculated and stored in a nonvolatile memory within the recording apparatus.

If an image to be consecutively printed is present, the printing operation is continued after comparing the remaining amount of ink with the number of dots to be printed, as described above.

Figure 13:
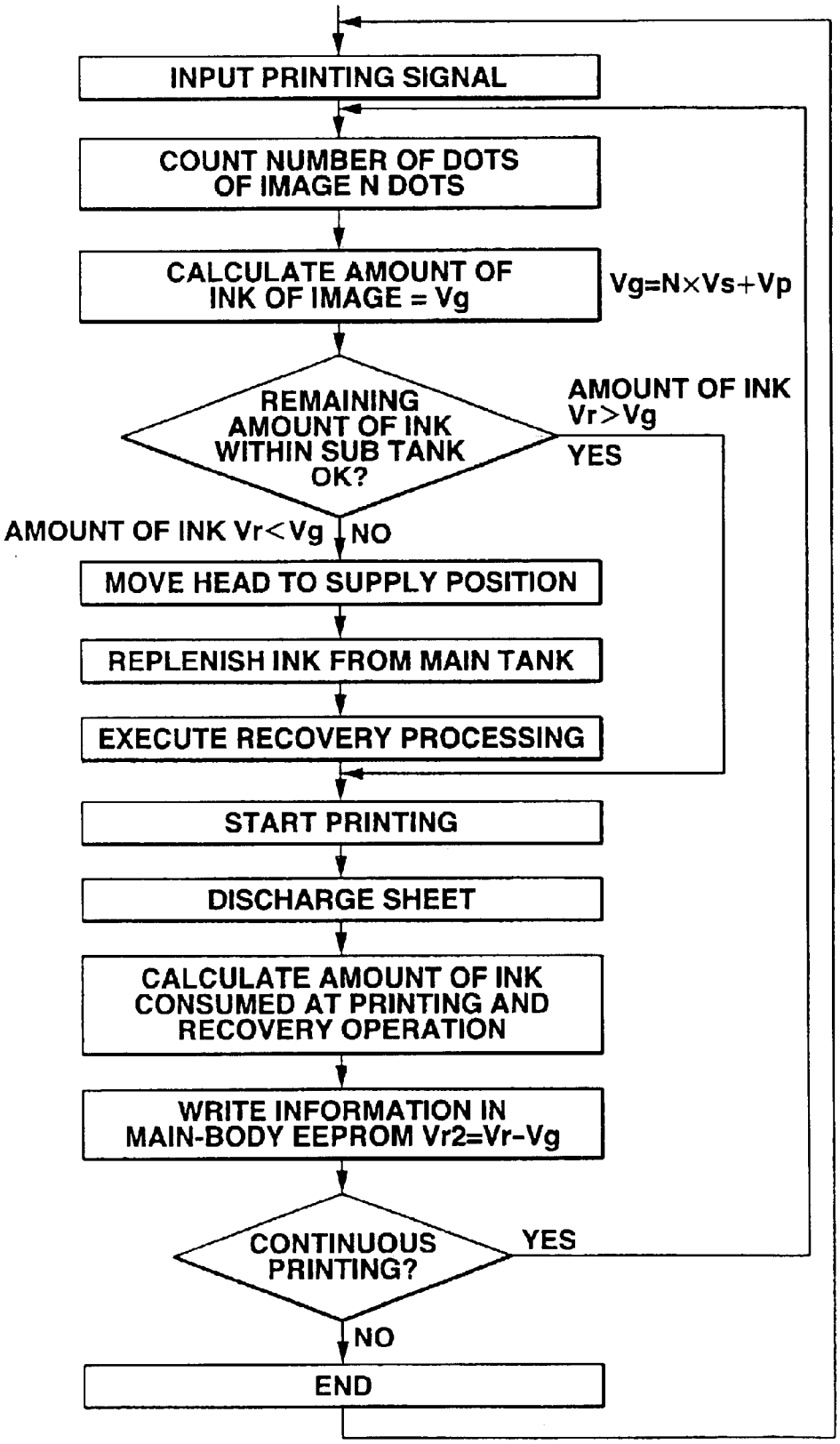
FIG. 13 is a flowchart illustrating a sequence according to the third embodiment.

FIG. 13 is flowchart illustrating the sequence of the third embodiment described with reference to FIGS. 12A and 12B.

In the third embodiment, the minimum amount of ink within the subtank is managed. When the remaining amount of ink within the subtank becomes less than 25%, an ink replenishing operation is unconditionally performed. This is because the amount of ink is calculated by counting dots as described above, and errors due to variations in the amount of ink discharge and in a recovery operation are taken in consideration.

If a printing operation is ended in a state in which the amount of ink remaining within the subtank is very small and the head is left in this state, clogging of nozzles due to evaporation of water may occur. Accordingly, by leaving the head in a state in which the remaining amount of ink is not very small, it is possible to simplify recovery processing and improve stability of ink discharge at the next printing operation. Although in the third embodiment, the minimum remaining amount is set to 25%, the present invention is not limited to this value, provided that the remaining amount is within a range of 10–25%.

By thus managing the amount of ink remaining within the subtank, and calculating the amount of ink to be consumed for an image of at least one sheet to be printed and comparing the calculated amount with the remaining amount, it is possible to execute periodic ink replenishment and continuous printing, process waste ink with a minimum recovery process time, and always perform stable printing.

The individual components shown in outline in the drawings are all well known in the ink-jet recording apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus comprising:

an ink tank having an ink accommodating portion for storing ink to be discharged from a discharge port;

a carriage for moving while mounting said ink tank;

a main tank separable from the ink tank having a supply portion to be connected to the ink accommodating portion of said ink tank when replenishing ink to said ink tank;

derivation means for deriving an amount of ink remaining within said ink tank;

calculation means for calculating an amount to be used of ink based on data to be recorded;

comparison means for comparing the amount of ink remaining within said ink tank derived by said derivation means with the amount to be used of ink calculated by said calculation means; and control means for performing control so that when it is determined that ink is to be replenished to said ink tank as a result of comparison by said comparison means, said ink tank is moved by said carriage, the ink accommodating portion of said ink tank is connected to the supply portion of said main tank, and ink is replenished from said main tank to said ink tank, wherein said ink tank accommodates ink whose amount is equal to or more than an amount of ink necessary for performing recording with a duty ratio of 100% on an entire surface of a maximum-size recording medium that can be recorded by said ink-jet apparatus and equal to or less than twice an amount of ink necessary for performing recording with a duty ratio of 100% on an entire surface of a maximum-size recording medium that can be recorded by said ink-jet recording apparatus.

2. An ink-jet recording apparatus according to claim 1, wherein an ink-jet head having the discharge port and said ink tank is inseparably integrated.

3. An ink-jet recording apparatus according to claim 1, wherein said derivation means detects the remaining amount of ink utilizing an electric resistance value.

4. An ink-jet recording apparatus according to claim 1, wherein said derivation means calculates the remaining amount of ink based on a counted value of a number of dots of ink droplets discharged from the discharge port.

5. An ink-jet recording apparatus according to claim 1, wherein the data to be recorded is data for one sheet of a recording medium to be recorded.

6. A method for operating an ink-jet recording apparatus including an ink tank having an ink accommodating portion for storing ink to be discharged from a discharge port, a carriage for moving while mounting the ink tank, and a main tank separable from the ink tank having a supply portion to be connected to the ink accommodating portion of the ink tank when replenishing ink to the ink tank, said method comprising:

a derivation step of deriving an amount of ink remaining within the ink tank;

a calculation step of calculating an amount to be used of ink based on data to be recorded;

a comparison step of comparing the amount of ink remaining within the ink tank derived in said derivation step with the amount to be used of ink calculated in said calculation step;

a moving step of moving the ink tank by the carriage when it is determined that ink is to be replenished to the ink tank as a result of comparison in said comparison step;

a connection step of connecting the accommodating portion of the ink tank to the supply portion of the main tank; and a replenishing step of replenishing ink from the main tank to the ink tank, wherein said ink tank accommodates ink whose amount is equal to or more than an amount of ink necessary for performing recording with a duty ratio of 100% on an entire surface of a maximum-size recording medium that can be recorded by said ink-jet apparatus and equal to or less than twice an amount of ink necessary for performing recording with a duty ratio of 100% on an entire surface of a maximum-size recording medium that can be recorded by said ink-jet recording apparatus.

7. A method according to claim 6, wherein wiping of a surface where the discharge port is provided, and preliminary discharge not relating to recording is executed after said replenishing step.

8. A method according to claim 7, wherein the wiping is executed within 0–5 seconds after said replenishing step.

9. A method according to claim 6, wherein after said replenishing step, a suction recovery operation of performing suction by a negative pressure while covering the discharge port with a cap, or a pressurizing recovery operation of discharging ink from the discharge port by pressurization is performed.

10. A method according to claim 6, wherein said replenishing step is executed utilizing a suction recovery operation of performing suction by a negative pressure while covering the discharge port with a cap, or a pressurizing recovery operation of discharging ink from the discharge port by pressurization.

11. A method according to claim 10, wherein a plurality of ink tanks, each for storing a corresponding one of ink liquids of a plurality of colors, and a plurality of main tanks provided so as to correspond to the plurality of ink tanks are provided, and wherein ink replenishment from a main tank corresponding to an ink tank for which it is determined that ink is to be replenished preferentially as a result of comparison in said comparison step is performed using a pressure higher than in replenishment of ink liquids of other colors.

* * * * *